United States Patent [19]

Oster

[11] 4,410,932

[45] Oct. 18, 1983

[54] ELECTRIC LAMP

[75] Inventor: Joseph Oster, Allentown, Pa.

[73] Assignee: Keystone Lamp Mfg. Corporation, Slatington, Pa.

[21] Appl. No.: 272,448

[22] Filed: Jun. 11, 1981

[51] Int. Cl.[3] ..... F21V 29/00

[52] U.S. Cl. ..... 362/294; 362/299; 362/359; 362/309; 362/301; 362/328; 362/339; 362/345; 362/355

[58] Field of Search ..... 362/294, 299, 147, 300, 362/301, 328, 339, 345, 353, 355, 359, 360, 414, 309

[56] References Cited

U.S. PATENT DOCUMENTS

| | | | |
|---|---|---|---|
| 2,185,694 | 1/1940 | Noe | 362/414 X |
| 2,901,596 | 8/1959 | Bell et al. . | |
| 4,041,305 | 8/1977 | Dean | 362/328 X |
| 4,175,661 | 11/1979 | Barnes | 362/355 X |
| 4,195,330 | 3/1980 | Savage, Jr. | 362/353 X |
| 4,293,899 | 10/1981 | Sanner | 362/345 X |

FOREIGN PATENT DOCUMENTS

| | | | |
|---|---|---|---|
| 527388 | 7/1958 | Canada . | |
| 634390 | 1/1962 | Canada . | |
| 1479617 | 4/1966 | France | 362/360 |
| 54-144089 | 9/1979 | Japan | 362/355 |

*Primary Examiner*—Peter A. Nelson
*Attorney, Agent, or Firm*—Seidel, Gonda & Goldhammer

[57] ABSTRACT

A table, wall, ceiling or desk lamp is provided with a translucent plastic shade having a top reflector at its upper end and bonded at its lower end to the outer periphery of a prismatic diffuser whereby the shade, top reflector and diffuser may be removed as a unit.

13 Claims, 10 Drawing Figures

FIG. 1
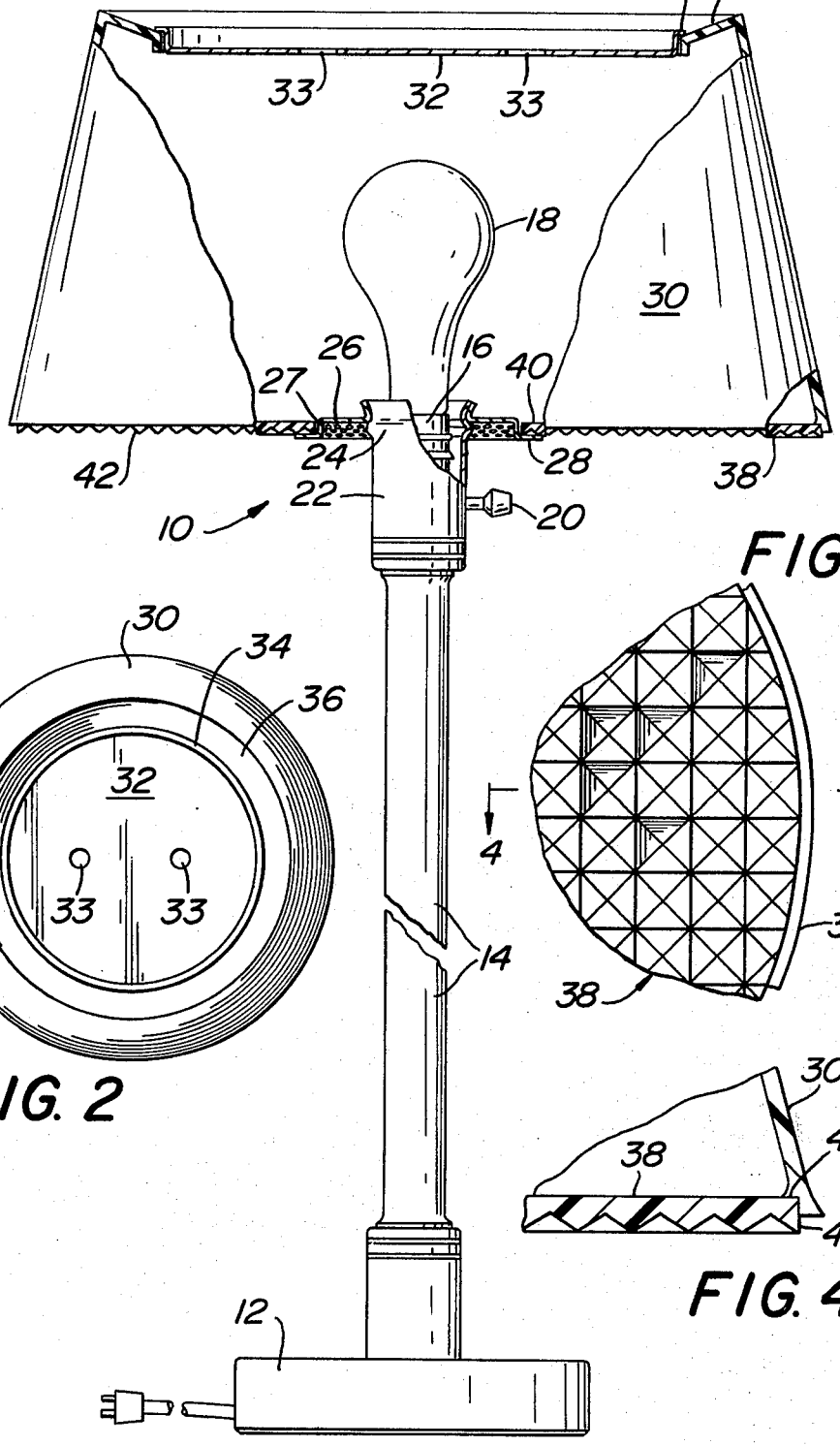
FIG. 3
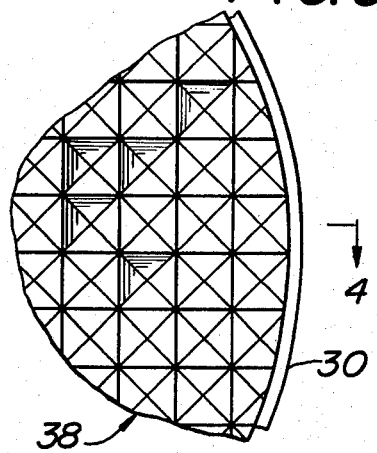
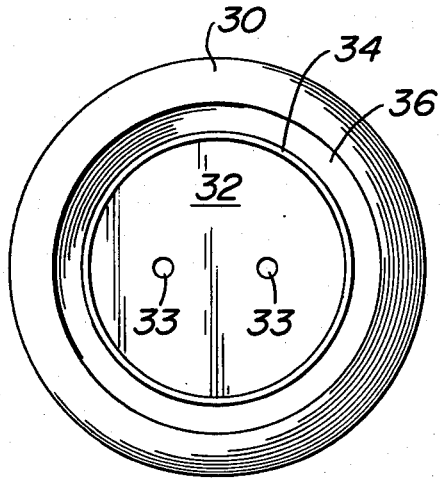
FIG. 2
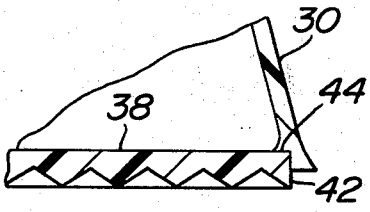
FIG. 4

FIG. 5
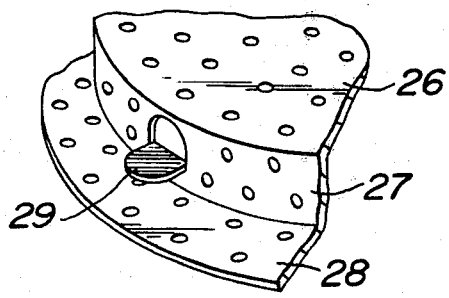
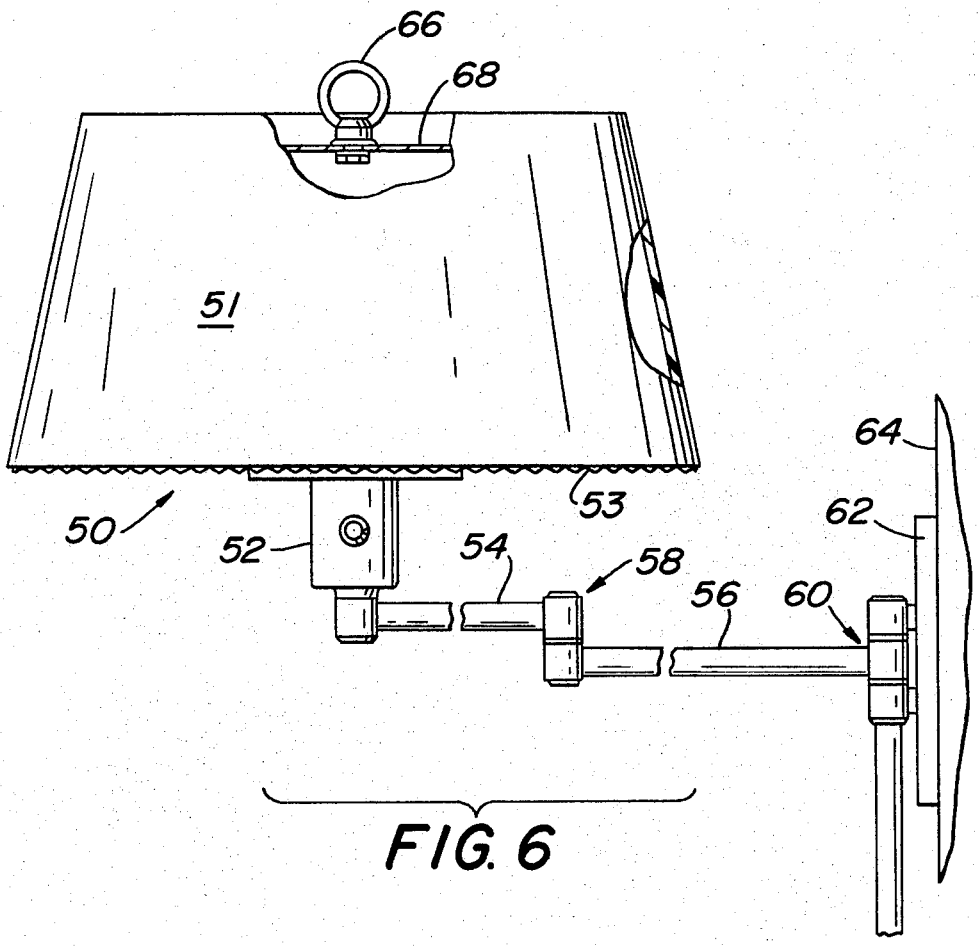
FIG. 6

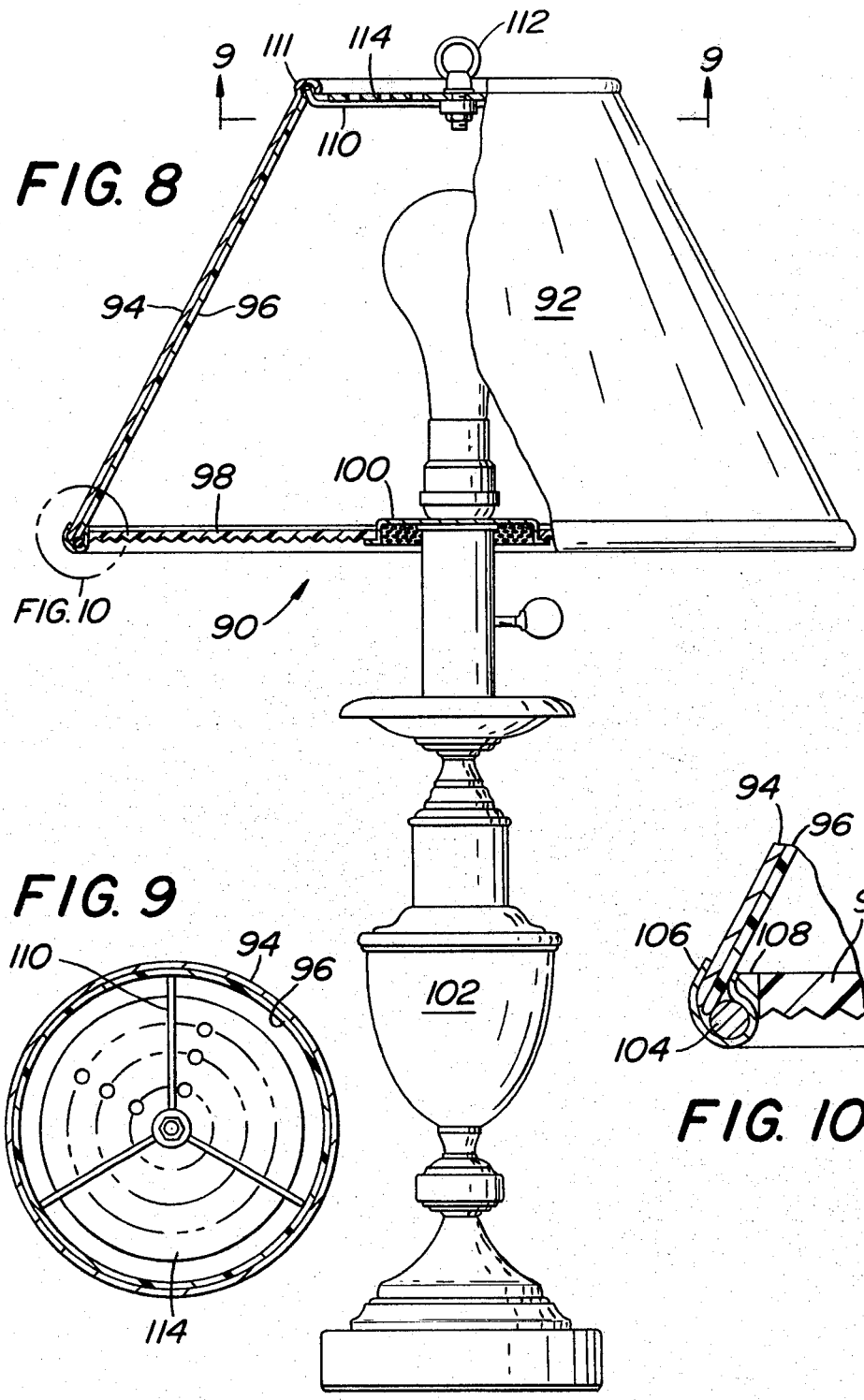
FIG. 8
FIG. 9
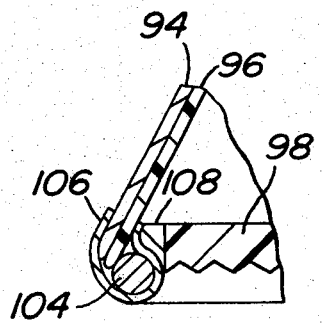
FIG. 10

ELECTRIC LAMP

BACKGROUND

Table lamps conventionally have a shade which is open at the top and open at the bottom. Table lamps with shades having top and bottom diffusers are also known. Desk lamps generally have a top reflector for reflecting light downwardly to thereby provide more light at the base of the lamp. However, desk lamps generally do not include a shade. Ceiling mounted flourescent light fixtures are known to have a top reflector with a prismatic diffuser at the lower end of the fixture and flush with the ceiling.

The present invention is directed to the solution of the problem of how to construct a lamp having a shade and having maximum candle power at the base of the lamp for more efficient use of the light source.

SUMMARY OF THE INVENTION

The present invention is directed to an electrical lamp. The lamp includes an upright support having a radially outwardly directed flange adjacent a bulb socket. The lamp includes an annual polymeric plastic shade which surrounds said socket. A horizontally disposed reflector is provided at the upper end of the shade for reflecting light downwardly.

The lamp includes an annular rigid diffuser of polymeric plastic. The diffuser has its outer periphery bonded to the lower end portion of the shade to form an integral unit. The inner periphery of the diffuser may rest on the upper surfaces of said flange. The shade and diffuser are vertically removable as a unit. The lamp includes means for defining air flow passages so that air may flow upwardly in an axial direction through the shade.

It is an object of the present invention to provide a lamp having maximum candle power at the base of the lamp for more efficient use of a light source.

Other objects and advantages of the present invention will appear hereinafter.

For the purpose of illustrating the invention, there is shown in the drawings a form which is presently preferred; it being understood, however, that this invention is not limited to the precise arrangement and instrumentalities shown.

FIG. 1 is an elevation view of the lamp of the present invention with portions broken away for purposes of illustration.

FIG. 2 is a top plan view of the lamp shown in FIG. 1 but on a smaller scale.

FIG. 3 is a partial bottom view of the shade and diffuser on an enlarged scale.

FIG. 4 is a sectional view taken along the line 4—4 in FIG. 3.

FIG. 5 is a partial perspective view of the shade support.

FIG. 6 is a elevation of the lamp in FIG. 1 supported by a wall.

FIG. 8 is an elevation view of a table lamp in accordance with another embodiment.

FIG. 9 is a sectional view taken along the line 9—9 in FIG. 8.

FIG. 10 is an enlargement of a lower corner of the shade in FIG. 8.

DETAILED DESCRIPTION

Figure 7:
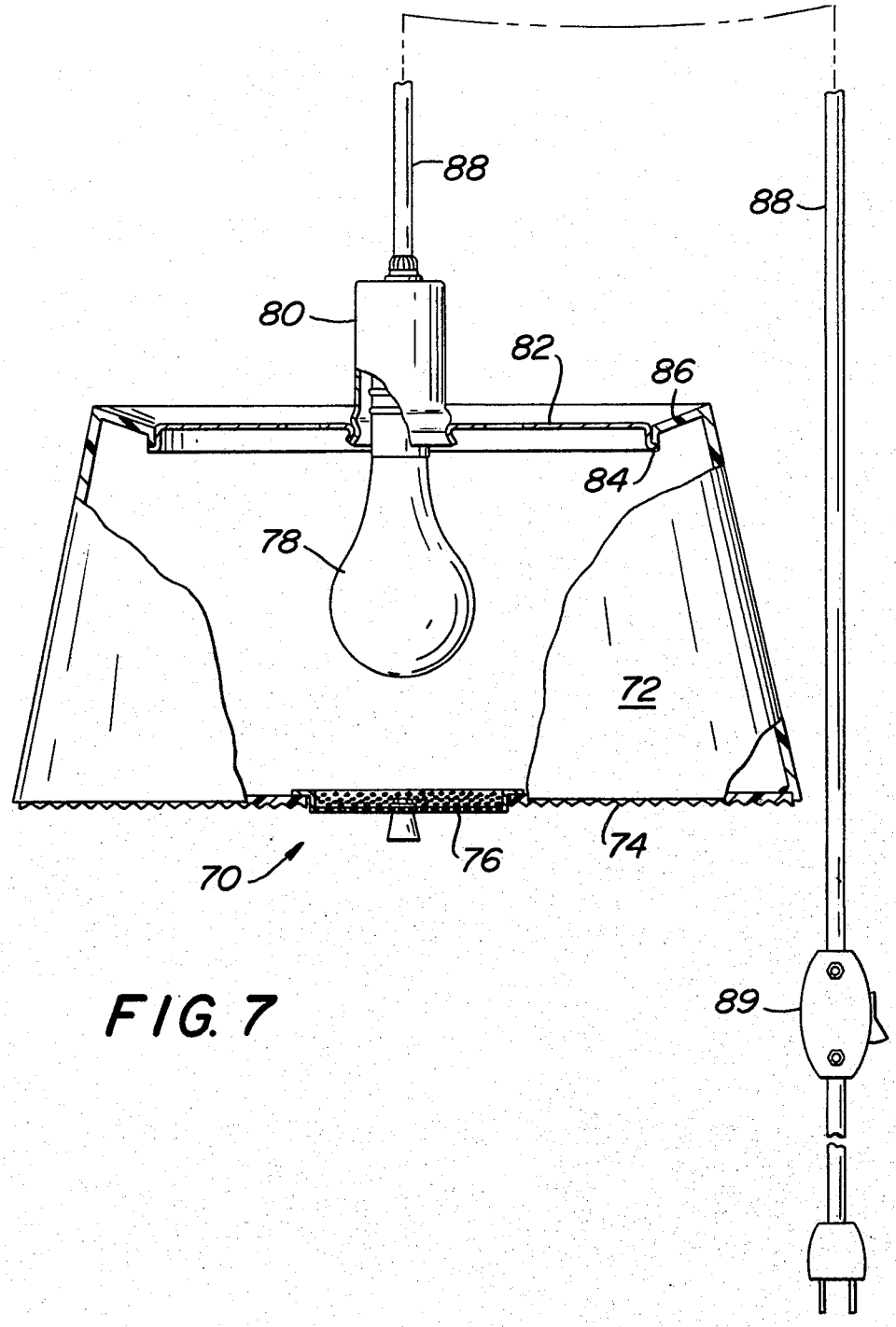
FIG. 7 is an elevation view of a ceiling supported lamp in accordance with another embodiment.

Referring to the drawing in detail, wherein like numerals indicate like elements, there is shown in FIG. 1 a lamp in accordance with the present invention designated generally as 10. The lamp 10 includes a conventional base 12 from which extends an electrical cord. A conventional standard 14 is mounted on the base 12 and extends upwardly. Depending on the length of standard 14, lamp 10 is a floor lamp, desk lamp or table lamp. At the upper end of the standard 14, there is provided a conventional socket 16 for receiving a conventional bulb 18. The bulb 18 is activated by way of switch 20. The upper end of the standard 14 terminates in a tubular collar 22 having a radially outwardly directed bead 24 below its upper edge.

A shade support 26 is fixedly secured to the upper end of the collar 22. The shade support 26 in section simulates a tophat. The inner periphery of the support 26 surrounds the upper end portion of the collar 22 and is swaged outwardly at a location above the bead 24. Hence, bead 24 supports the shade support 26.

The shade support 26 is perforated and is preferably made from sheet metal. The outer periphery of the support 26 includes a horizontally disposed flange extending radially outwardly from an axially directed shoulder 27. Shoulder 27 has a lip 29 struck therefrom and extending radially outwardly as shown in FIG. 5.

The lamp 10 includes a shade 30 which preferably assumes the form of a truncated cone. Shade 30 is preferably injection molded from polymeric plastic material such as translucent polypropolene with a thickness of about 0.06 to 0.09 inches. At its upper end, shade 30 has an integral flange 36 extending radially inwardly and preferably inwardly and downwardly as illustrated in FIG. 1. Flange 34 supports a reflector 32.

The reflector 32 is preferably sheet metal painted white or some other color so as to reflect light downwardly. Reflector 32 has a radially outwardly directed flange 34 which rests on the inner edge portion of the flange 36. While reflector 32 is preferably separate from shade 30, the reflector 32 may be secured to the flange 36. One or more air vent holes 33 may be provided in the reflector 32 which acts like a top wall for the shade 30. Any light which normally would escape upwardly is reflected downwardly by the reflector 32.

A diffuser 38 is provided. Diffuser 38 is preferably annular so as to have an inner peripheral portion 40 supported by the flange 28 on support 26 and below lip 29 which retains the diffuser to prevent accidental upsets. When installing or removing the shade, it must be tilted in circumvent lip 29. The outer periphery of diffuser 38 is adhesively bonded or welded to the lower edge portion of the shade 30. As shown more clearly in FIG. 4, the lower edge portion of shade 30 is provided with a notch 44 to increase the area of contact with the outer peripheral edge portion of the diffuser 38. It will be noted that the depth of the notch 44 is less than the thickness of diffuser 38 so that the outer periphery 42 of diffuser 38 is visible when the shade is observed in elevation. The exposed portion of surface 42 highlights the lamp 10 in that there is visible light in periphery 42 which is different from the light transmitted by the translucent shade 30.

By way of illustration and not by way of limitation, the following are preferred dimensional features of shade 30. Shade 30 at its lower edge has a diameter of about 14 inches, as a diameter at its upper end of 11 inches, and is 7 inches high. Flange 36 extends radially inwardly for a distance of about 1⅛ inches. The diffuser 38 preferably has a inner diameter of about 3½ inches and an outer diameter of about 14 inches while having a thickness of about 0.140 to 0.150 inch. A diffuser 38 of that thickness will be sufficiently rigid so as to support the shade 30 and reflector 32. Diffuser 38 is preferably a prismatic diffuser made from a polymeric plastic such as optically clear polystyrene which meets Class C, IES, NEMA-SPI standards.

In use, the light from bulb 18 is directed in all directions. Part of the light will be directed downwardly through the diffuser 38. Another part of the light will be reflected off reflector 32 and directed downwardly through the diffuser 38. Since the diffuser 38 and shade 30 are fixedly secured together, they may be removed upwardly as a unit. The inner diameter of diffuser 38 is greater than the outer diameter of the bulb 18 so that the bulb need not be disturbed when removing the shade 30, diffuser 38, and the reflector 32 which is supported by the shade 30. Diffuser 38 is preferably light-stable and optically designed to provide a sharp, clearly defined cut-off with prisms designed to reflect light beams on angular axes. The sum of these features is excellent light emission with control of direct glare that is within the recognized scissors curve requirements.

The superiority of the present invention was proven by measurements made adjacent the base 12 with the diffuser 38 being 15½ inches from the surface supporting the lamp 10. At each wattage level, the presence of both the reflector 32 and diffuser 38 provided substantially greater foot candles when compared with (a) only reflector 32, (b) only diffuser 38, and (c) with diffuser 38 and reflector 32 both being absent.

Since the bulb 18 is enclosed by the shade 30, diffuser 38 and reflector 32, the heat associated with the bulb must be accommodated. The perforations in support 26 cooperate with the holes 33 in the reflector to provide for a vertical flow passage upwardly through the shade 30. Greater efficiency is attained by having the flow passages in the support 26 so that such flow passages are immediately adjacent the source of heat.

In FIG. 6, there is illustrated an electrical lamp 50 in accordance with another embodiment of the present invention. Lamp 50 is identical with lamp 10 except as will be made clear hereinafter. Lamp 50 includes a collar 52 comparable to collar 22. Collar 52 supports the shade 51 and diffuser 53 in the same manner as described above. The reflector 68 is supported from the upper end of the shade 51 in the same manner as described above but is provided with a finial 66.

The lower end of the collar 52 is pivotably connected to one end of an arm 54. Arm 54 is pivotably connected by a swivel 58 to one end of arm 56. The other end of arm 56 is pivotably connected by a swivel 60 to a bracket 62. Bracket 62 is attached to a vertically disposed wall 64. Thus, the lamp of the present invention may be a wall supported lamp in addition to being a desk or table lamp.

In FIG. 7, there is illustrated another embodiment of the present invention wherein the lamp 70 is adapted to be supported by a ceiling or other structure thereabove. Lamp 70 is identical with lamp 10 except as will be made clear hereinafter. The shade 72 is connected at its lower end to the outer periphery of a diffuser 74 as described above. A perforated plate 76, similar to plate 26 but upsidedown, is provided in association with the inner periphery of the diffuser 74. Plate 76 facilitates relamping the bulb 78 and preferably has flats on its periphery so that it may be tilted and withdrawn from the position shown in FIG. 7 when relamping is necessary.

The collar 80, comparable to collar 22, is supported from above by the conductor 88. Conductor 88 includes a switch 89 and is adapted to be suspended from hooks or rings attached to a ceiling or other support. The reflector 82 is attached at its inner periphery to the outer periphery of collar 80. The outer periphery of reflector 82 includes a horizontally disposed flange 84 which supports the inwardly directed flange 86 on the shade 72. Reflector 82 is the same as reflector 32 but is upside down whereby the shade 72 and diffuser 74 are supported by the flange 84 on the reflector 82.

In FIGS. 8–10 there is illustrated another embodiment of the present invention in the form of a table lamp designated 90. The lamp 90 is the same as lamp 10 except as will be made clear hereinafter. The shade 92 has a fabric layer 94 overlying a plastic layer 96. Plastic layer 96 may be thinner than the thickness of shade 30. The outer periphery of diffuser 98 is bonded to the lower end of the shade 92. The inner periphery of the diffuser 98 is supported by a perforated shade support 100. Support 100 is removably attached to the upper end of a conventional base 102.

As shown more clearly in FIG. 10, the lower end of the layers 94, 96 are attached to a circular wire ring 104 by way of conventional tape 106. Adhesive 108 bonds the outer periphery of diffuser 98 to the tape 106.

As shown more clearly in FIGS. 8 and 9, the lamp 90 may be provided with a conventional spider 110 connected to a wire ring which is connected to the upper end of layers 94, 96 by a tape 111. The spider 110 has a conventional finial 112 which extends through and is clamped to a reflector 114. When the finial 112 is pulled upwardly, the entire shade and diffuser are raised as a unit. If desired, support 100 may be provided with a lip comparable to lip 29.

The present invention involves a unique structural interrelationsip of components which per se are old in the art and involving a change in such known components as to location and shape. As a result thereof, the lamp is simple, inexpensive and reliable while providing for substantially increased candle power at the base of the lamp. As a result, there is a more effective use of the energy from the light bulb.

The present invention may be embodied in other specific forms without departing from the spirit or essential attributes thereof and, accordingly, reference should be made to the appended claims, rather than to the foregoing specification, as indicating the scope of the invention.

I claim:

1. An electric lamp for use on a floor, wall, ceiling, desk or table comprising an upright lamp support having a socket provided with means for attaching a light bulb to said socket, an annular polymeric plastic shade surrounding said socket, a horizontally disposed reflector at the upper end of said shade reflecting light downwardly, said shade and reflector being discrete and separable, an annular rigid diffuser of polymeric plastic, said diffuser having it outer periphery bonded to the lower edge portion of said shade and having a central opening therein of sufficient size to clear said socket and the attached light bulb to permit vertical removal of said shade and diffuser as an integral unit, and means defining air flow passages so that air may flow upwardly in an axial direction through the shade.

2. A lamp in accordance with claim 1 wherein the outer periphery of said diffuser is visible immediately below the lower edge of said shade.

3. A lamp in accordance with claim 1 wherein said lamp support includes a radially outwardly directed flange, the inner periphery of said diffuser resting on said flange, said flange being perforated with the perforations being part of said last-mentioned means.

4. A lamp in accordance with claim 3 wherein said last-mentioned means also includes holes in said reflector.

5. A lamp in accordance with claim 1 wherein the shade has a radially inwardly and downwardly angled flange at its upper edge, said reflector periphery and said shade flange having an overlapping relationship.

6. A lamp in accordance with claim 1 wherein said diffuser is a prismatic diffuser of optically clear plastic which is thicker than the thickness of said shade.

7. A lamp in accordance with claim 1 wherein said lamp support is selected from the group consisting of:

(a) a base to be supported by a table, desk or floor with the shade and diffuser at the upper end thereof;

(b) a wall bracket having an arm with the shade and diffuser at a free end of said arm, and (c) a support adapted to be suspended from above and having its lower end connected to said reflector which supports said shade.

8. An electrical lamp comprising an upright lamp supported provided with a socket for attachment of a light bulb thereto, a shade support secured to the upper end of said lamp support and extending radially outwardly therefrom, said shade support being perforated at a location radially inwardly from a flange on the outer periphery thereof, a polymeric plastic shade having a reflector supported by the upper end thereof for reflecting light downwardly, an annular rigid diffuser of optically clear polymeric plastic, said diffuser having its outer periphery bonded to the lower edge portion of the shade to form an integral unit therewith and further having a central opening therein, the periphery of said opening resting on said flange and said opening being of sufficient size to clear said socket and the attached light bulb to permit vertical removal of said shade and diffuser as a unit, said diffuser being horizontally disposed and being thicker than the thickness of said shade, said reflector having holes so that air may flow upwardly in an axial direction through the shade, passing through the perforations in said shade support and the holes in said reflector.

9. A lamp in accordance with claim 8 wherein said diffuser is a prismatic diffuser having a portion of its outer periphery positioned within a notch on the lower end of said shade.

10. A lamp in accordance with claim 8 wherein the outer periphery of said diffuser is visible immediately below the lower edge of said shade.

11. An article for use in an electrical lamp comprising an annular translucent polymeric plastic shade, a horizontally disposed reflector coupled to the upper end of said shade for reflecting light downwardly, an annular rigid diffuser of polymeric plastic, said diffuser having its outer periphery bonded to the lower edge portion of said shade to form an integral unit, and air flow passages in the reflector so that air may flow upwardly in an axial direction through the shade, said diffuser being provided with a central opening therein of a size sufficient to permit integral axial removal of said shade and diffuser from the lamp.

12. An article in accordance with claim 11 wherein the outer periphery of said diffuser is visible immediately below the lower edge of said shade.

13. An article in accordance with claim 11 including a layer of fabric surrounding the shade.

* * * * *